US009278829B2

(12) United States Patent
Benosman

(10) Patent No.: US 9,278,829 B2
(45) **Date of Patent: *Mar. 8, 2016**

(54) METHOD AND SYSTEM FOR CONTROLLING SWAY OF ROPES IN ELEVATOR SYSTEMS BY MODULATING TENSION ON THE ROPES

(71) Applicant: Mitsubishi Electric Research Laboratories, Inc., Cambridge, MA (US)

(72) Inventor: Mouhacine Benosman, Boston, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 676 days.

This patent is subject to a terminal disclaimer.

(21) Appl. No.: 13/670,632

(22) Filed: Nov. 7, 2012

(65) Prior Publication Data

US 2014/0124300 A1 May 8, 2014

(51) Int. Cl.
*B66B 1/34* (2006.01)
*B66B 7/06* (2006.01)

(52) U.S. Cl.
CPC ..... *B66B 7/06* (2013.01)

(58) Field of Classification Search
CPC B66B 1/302; B66B 1/2416; B66B 2201/103; B66B 2201/216; B66B 25/00; B66B 7/06; Y02B 50/225
USPC ..... 187/247, 277, 292, 293, 391, 393, 412
See application file for complete search history.

(56) References Cited

U.S. PATENT DOCUMENTS

| | | | | |
|---|---|---|---|---|
| 5,509,503 | A * | 4/1996 | Salmon | 187/266 |
| 5,861,084 | A * | 1/1999 | Barker et al. | 187/264 |
| 8,579,089 | B2 * | 11/2013 | Hakala et al. | 187/293 |
| 9,038,783 | B2 * | 5/2015 | Roberts et al. | 187/412 |
| 2013/0133983 | A1 * | 5/2013 | Mangini et al. | 187/277 |
| 2013/0173206 | A1 * | 7/2013 | Benosman et al. | 702/141 |
| 2013/0275081 | A1 * | 10/2013 | Benosman et al. | 702/150 |
| 2014/0000985 | A1 * | 1/2014 | Fukui et al. | 187/247 |
| 2014/0069747 | A1 * | 3/2014 | Benosman | 187/414 |
| 2014/0229011 | A1 * | 8/2014 | Fukui et al. | 700/275 |
| 2015/0008075 | A1 * | 1/2015 | Benosman et al. | 187/247 |
| 2015/0027814 | A1 * | 1/2015 | Benosman | 187/247 |
| 2015/0166304 | A1 * | 6/2015 | Roberts et al. | 187/278 |

FOREIGN PATENT DOCUMENTS

| | | |
|---|---|---|
| CN | 1197034 A | 10/1998 |
| JP | H10279224 | 10/1998 |

* cited by examiner

*Primary Examiner* — Anthony Salata
(74) *Attorney, Agent, or Firm* — Gene Vinokur; Dirk Brinkman

(57) ABSTRACT

A method controls an operation of an elevator system using a control law to stabilize a state of the elevator system using a tension of an elevator rope. A derivative of a Lyapunov function along dynamics of the elevator system controlled by the control law is negative definite. The control law is a function of amplitude of a sway of the elevator rope and a velocity of the sway of the elevator rope. The method determines the amplitude of the sway of the elevator rope and the velocity of the sway of the elevator rope during the operation, and determines a magnitude of the tension of the elevator rope based on the control law, and the amplitude and the velocity of the sway of the elevator rope.

18 Claims, 9 Drawing Sheets

100-A

100-B

100-C

100-D

100-E

200

301

METHOD AND SYSTEM FOR CONTROLLING SWAY OF ROPES IN ELEVATOR SYSTEMS BY MODULATING TENSION ON THE ROPES

FIELD OF THE INVENTION

This invention relates generally to elevator systems, and more particularly to reducing a sway of an elevator rope in an elevator system.

BACKGROUND OF THE INVENTION

Typical elevator systems include a car and a counterweight moving along guiderails in a vertical elevator shaft. The car and the counterweight are connected to each other by hoist ropes. The hoist ropes are wrapped around a sheave located in a machine room at the top or bottom of the elevator shaft. The sheave can be moved by an electrical motor, or the counterweight can be powered by a linear motor.

Rope sway refers to oscillation of the hoist and/or compensation ropes in the elevator shaft. The oscillation can be a significant problem in a roped elevator system. The oscillation can be caused, for example, by vibration due to wind induced building deflection and/or the vibration of the ropes during operation of the elevator system. If the frequency of the vibrations approaches or enters a natural harmonic of the ropes, then the oscillations can be greater than the displacements. In such situations, the ropes can tangle with other equipment in the elevator shaft, or come out of the grooves of the sheaves. If the elevator system uses multiple ropes and the ropes oscillate out of phase with one another, then the ropes can become tangled with each other and the elevator system may be damaged.

Various methods control the sway of the elevator rope by applying tension to the rope. However, the conventional methods use a constant control action to reduce the rope sway. For example, the method described in U.S. Pat. No. 5,861,084 minimizes horizontal vibration of elevator compensation ropes by applying a constant tension on the rope after the vibration of the rope is detected. However, applying a constant tension to the rope is suboptimal, because the constant tension can cause unnecessary stress to the ropes.

Another method, described in U.S. Patent Publication 2009/0229922 A1, is based on a servo-actuator that moves the sheave to shift the natural frequency of the compensation ropes to avoid the resonance of the compensation ropes with the natural frequency of the building. The servo-actuator is controlled by feedback that uses the velocity of the rope vibration at the extremity of the rope. However, that method only solves the problem of compensation rope vibration sway damping. Furthermore, that method necessitates the measurement of the ropes sway velocity at the extremity of the rope, which is difficult in practical applications.

The method described in U.S. Pat. No. 7,793,763 minimizes vibration of the main ropes of an elevator system using a passive damper mounted on the top of the car. The damper is connected to the car and the rope. Distances and a value of the damping coefficient of the damper are used to reduce the rope sway. However, in that method, the number of dampers is proportional to the number of ropes that are controlled. Furthermore, each damper is passive and engages continuously with the rope, which can induce unnecessary extra stress on the ropes.

Other methods, see, e.g., U.S. Pat. No. 4,460,065 and U.S. Pat. No. 5,509,503, use purely mechanical solutions to limit the sway amplitude by physically limiting the lateral motion of the rope. Those types of solutions can be costly to install and maintain.

Accordingly, there is a need to optimally reduce the sway of the elevator rope.

SUMMARY OF THE INVENTION

It is an objective of some embodiments of an invention to provide a system and a method for reducing a sway of an elevator rope connected to an elevator car in an elevator system by applying tension to the rope.

It is another objective of the embodiments, to provide a method that applies the tension optimally, e.g., only when necessary, such that maintenance of components of the elevator system can be decreased. For example, one embodiment of an invention discloses a method for reducing a lateral rope sway of elevator ropes by applying time varying tension on the ropes.

Embodiments of the invention are based on a realization that the tension applied to the elevator rope can be used to stabilize the elevator system. Therefore, the tension can be analyzed based on stability of the elevator system using a model of the elevator system. Various types of stability are used by embodiments for solutions of differential equations describing a dynamical system representing the elevator system.

For example, some embodiments require the dynamical system representing the elevator system to be Lyapunov stable. Specifically, the stabilization of the elevator system can be described by a control Lyapunov function, wherein the tension of the elevator rope stabilizing the elevator system is determined by a control law, such that a derivative of a Lyapunov function along dynamics of the elevator system controlled by the control law is negative definite. Some of those embodiments are also based on another realization that for an assumed mode of the dynamical system. The Lagrangian variables representing the assumed mode and its time derivative are related to the sway and velocity of the sway. The control Lyapunov function is a function of the Lagrangian variables, and thus, the control law determined using the control Lyapunov function can be related to the sway and velocity of the sway.

Accordingly, some embodiments determine a control law stabilizing a state of the elevator system based on the tension of an elevator rope using the Lyapunov control theory. Such an approach enables applying the tension optimally, e.g., only when the tension is necessary, which decreases the maintenance cost. For example, some embodiments apply the tension only in response to increasing the amplitude of the sway of the rope, which is advantageous over constant tension methods.

One embodiment determines the control law based on a model of the elevator system without external disturbance. This embodiment is advantageous when the external disturbance is minimal. Another embodiment modifies the control law with a disturbance rejection component to force the derivative of the Lyapunov function to be negative definite. This embodiment is advantageous for systems with the disturbance. In one variation of this embodiment, the external disturbance is measured during the operation of the elevator system. In another variation, the disturbance rejection component is determined based on boundaries of the external disturbance. This embodiment allows for compensating for disturbance without measuring the disturbance. This is advantageous because in general the disturbance measurements are not easily available, e.g. the sensors for external disturbances are expensive.

Also, in one embodiment the tension when applied to the elevator rope has a constant value, e.g., a maximum tension and switches to a minimum value, e.g. zero, at an optimal time instant based on the values of the sway amplitude and the sway velocity. This embodiment is relatively easy to implement. In another embodiment, a magnitude of the tension is a function of amplitude of the sway and decreases with the decrease of the sway amplitude and the sway velocity. Compared with some other embodiments, this embodiment uses less control energy.

DETAILED DESCRIPTION OF THE PREFERRED EMBODIMENT

Various embodiments of the invention are based on a realization that tension applied to an elevator rope can be used to stabilize an elevator system. Moreover, the stabilization of the elevator system can be described by a control Lyapunov function, such that the tension of the elevator rope stabilizing the elevator system ensures the negative definiteness of a derivative of the control Lyapunov function.

Some embodiments control an operation of an elevator system by changing the tension of the elevator rope based on the control law to reduce a sway of an elevator rope. Some embodiments are based on a realization that the tension of the rope can be used together with the Lyapunov theory to stabilize the elevator system, and thus stabilize the sway. By combining Lyapunov theory and the rope tension actuation, a switching controller, according to some embodiments, optimizes switching the control tension ON and OFF based on switching conditions, e.g., amplitude and velocity of the actual sway. The switching condition, as well as the amplitude of the positive tension to be applied, is obtained based on the Lyapunov theory.

Accordingly, the switching control allows applying tension to the rope only when necessary, i.e., when the switching conditions are met. Therefore, no unnecessary extra tension stress is applied to parts of the elevator system, such as the elevator ropes and sheaves, which can reduce the cost of the maintenance.

Figure 1A:
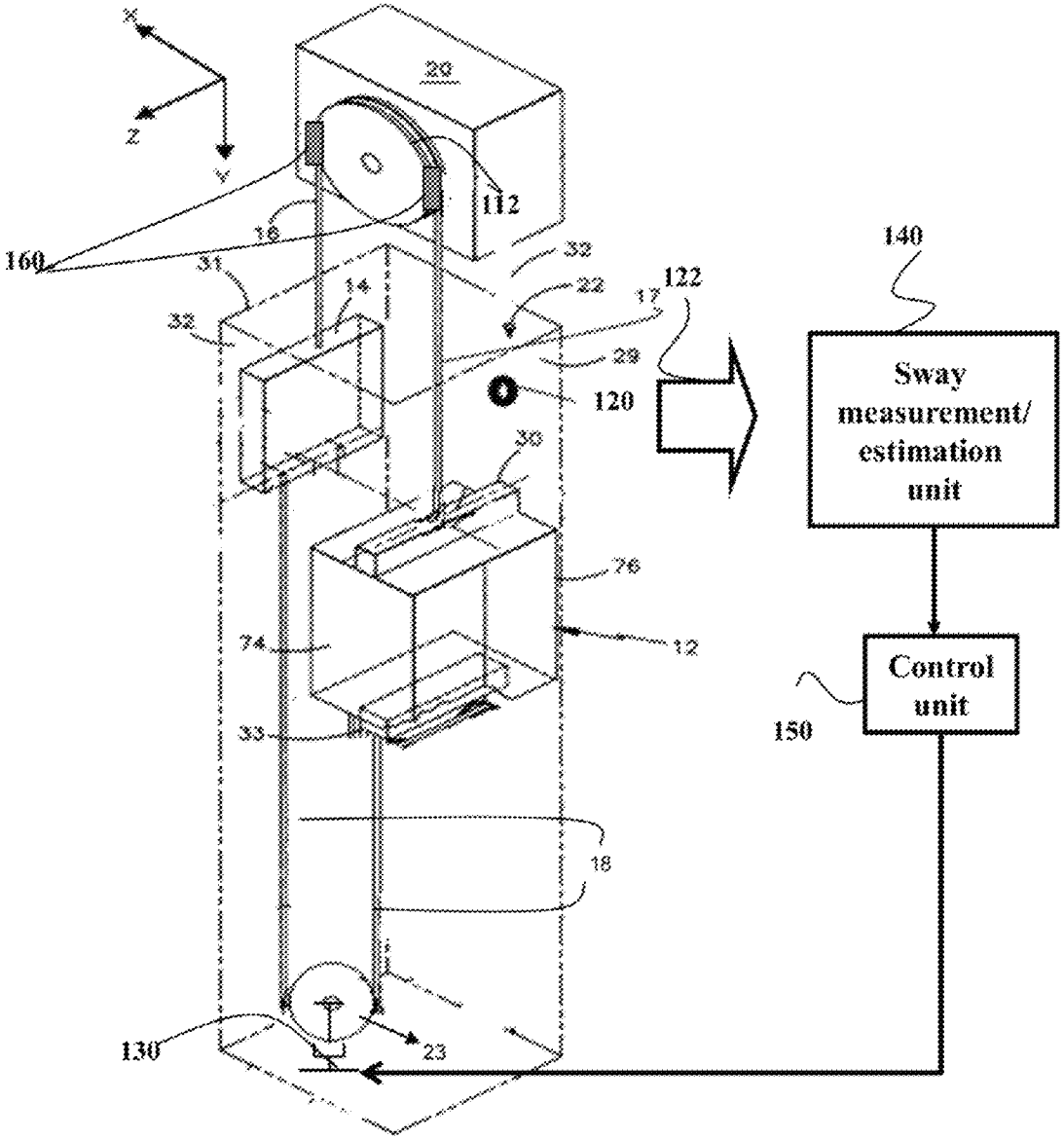
FIGS. 1A, 1B, 1C, 1D and 1E are schematics of exemplar elevator systems employing embodiments of the invention.

FIG. 1A shows a schematic of an elevator system 100-A according to one embodiment of an invention. The elevator system includes an elevator car 12 operably connected by at least one elevator rope to different components of the elevator system. For example, the elevator car and a counterweight 14 connect to one another by main ropes 16-17, and compensating ropes 18. The elevator car 12 can include a crosshead 30 and a safety plank 33. A pulley 20 for moving the elevator car 12 and the counterweight 14 through an elevator shaft 22 can be located in a machine room (not shown) at the top (or bottom) of the elevator shaft 22. The elevator system can also include a compensating pulley 23. An elevator shaft 22 includes a front wall 29, a back wall 31, and a pair of side walls 32.

The elevator car and the counterweight have a center of gravity at a point where summations of the moments in the x, y, and z directions are zero. In other words, the car 12 or counterweight 14 can theoretically be supported and balanced at the center of gravity (x, y, z), because all of the moments surrounding the center of gravity point are cancel out. The main ropes 16-17 typically are connected to the crosshead 30 of the elevator car 12 where the coordinates of the center of gravity of the car are projected. The main ropes 16-17 are connected to the top of the counterweight 14 the coordinates of the center of gravity of the counterweight 14 are projected.

During the operation of the elevator system, different components of the system are subjected to internal and external disturbance, e.g., sway due to wind, resulting in lateral motion of the components. Such lateral motion of the components can result in a sway of the elevator rope that needs to be measured. Accordingly, one or a set of sway sensors 120 can be arranged in the elevator system to determine a lateral sway of the elevator rope.

The set of sensors may include at least one sway sensor 120. For example, the sway sensor 120 is configured to sense a lateral sway of the elevator rope at a sway location associated with a position of the sway sensor.

However, in various embodiments, the sensors can be arranged in different positions such that the sway locations are properly sensed and/or measured. The actual positions of the sensors can depend on the type of the sensors used. For example, the sway sensor can be any motion sensor, e.g., a light beam sensor.

During the operation of the elevator system, the locations of the sway are determined and transmitted 122 to a sway measurement and estimation unit 140. The sway unit 140 determines the sway of the elevator rope by, e.g., using the sway measurement and an inverse model of the system. Various embodiments use different inverse models, e.g., an inverse model of the elevator system including the rope the pulley and the car, also various embodiments use different estimation method for estimating the rope sway from the measurements.

In one embodiment, a first sway sensor is placed at a neutral position of the rope corresponding to the initial rope configuration, i.e., no rope sway. The other sway sensors are arranged away from the neutral position and at the same height as the first sway sensor.

In the system 100-A, the rope sway is controlled by a force actuator 130 connected to the compensation sheave 23. The main sheave brakes 160 are engaged to stop any rotation of the main sheave. Then, the actuator 130 is used to pull on the compensation sheave 23 to generate external tension in the ropes. This tension stiffens the ropes and reduces the rope sway. The actuator 130 is controlled by the control unit 150 that calculates the amplitude of the extra tension applied to the ropes. The control unit also determines the time when the tension is ON and when the tension is OFF. The timing of the switching is based on the rope sway measurements obtained from the sway unit 140.

Figure 1B:
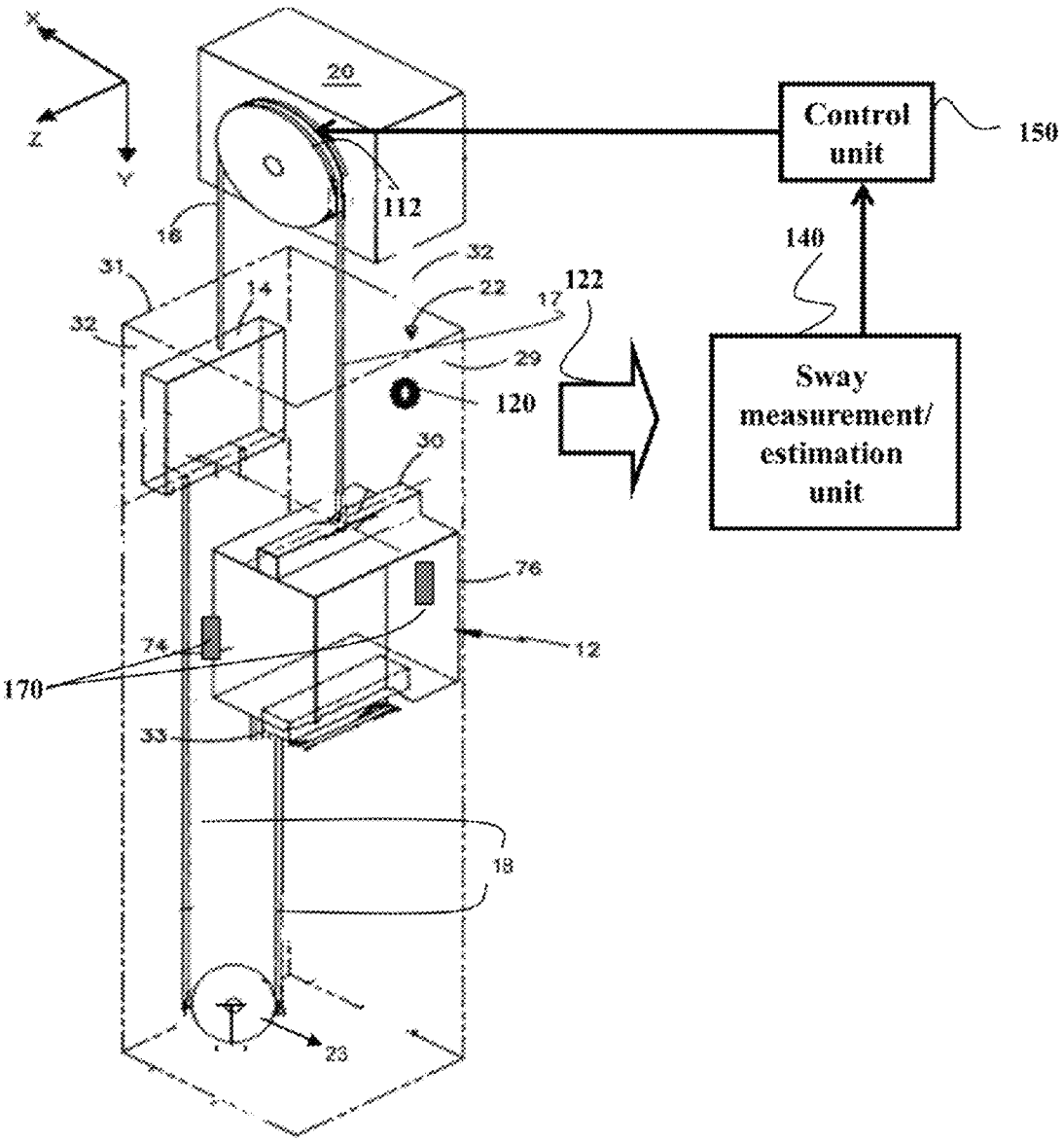

FIG. 1B shows a schematic of an elevator system 100-B according to another embodiment of an invention. In the system 100-B, the car motion is constrained using brakes 170, and the main sheave 112 is controlled to rotate and generate external tension on the main ropes. This tension stiffens the ropes and reduces the rope sway. The main sheave 112 is controlled by the control unit 150 that determines the amplitude of the extra tension applied to the ropes. The control unit also calculates the time when the tension is ON, and when the tension is OFF. The timing of the switching is computed by the control unit 150 based on the rope sway measurements obtained from the sway measurement/estimation unit 140.

Figure 1C:
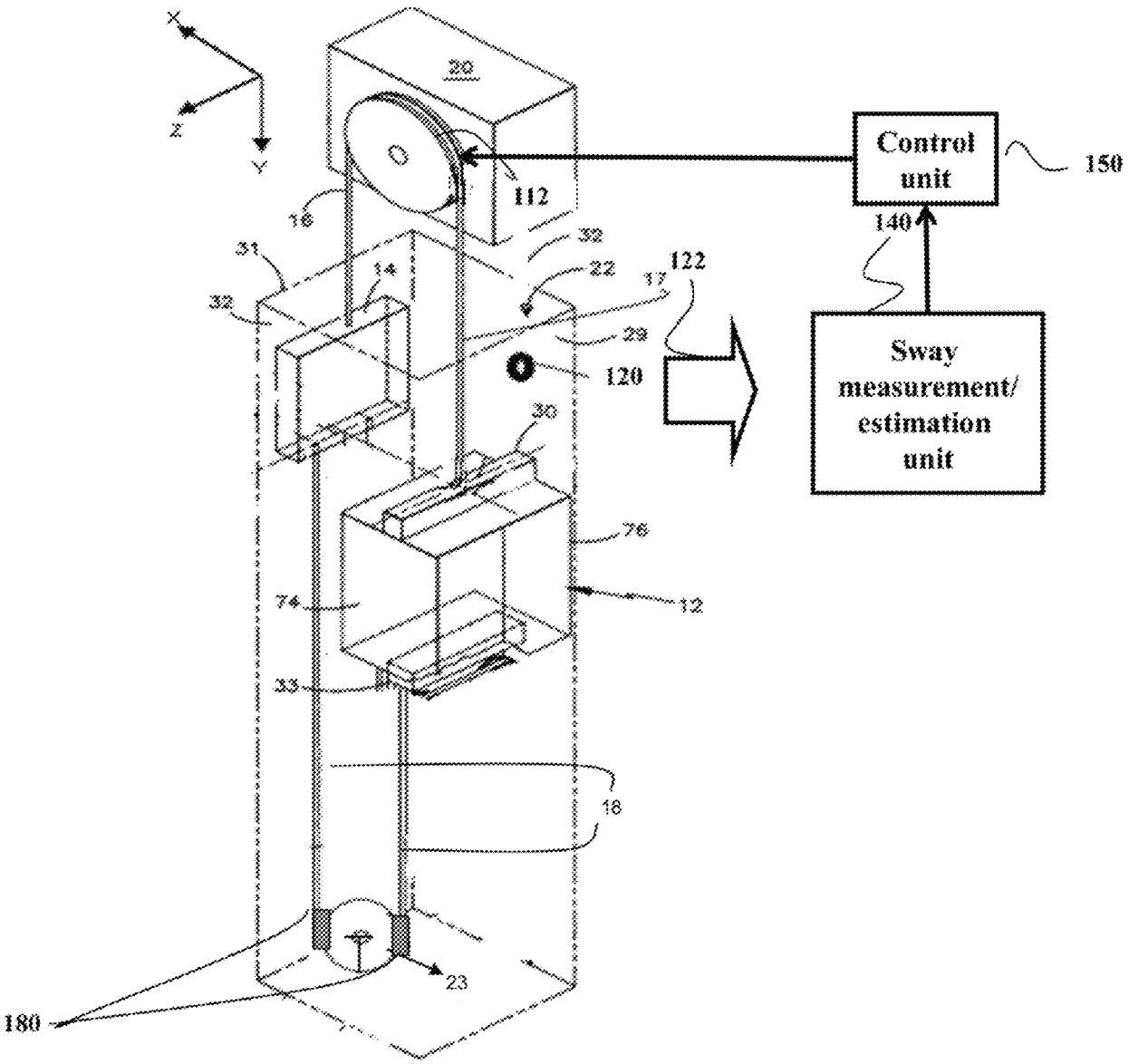
Figure 1D:
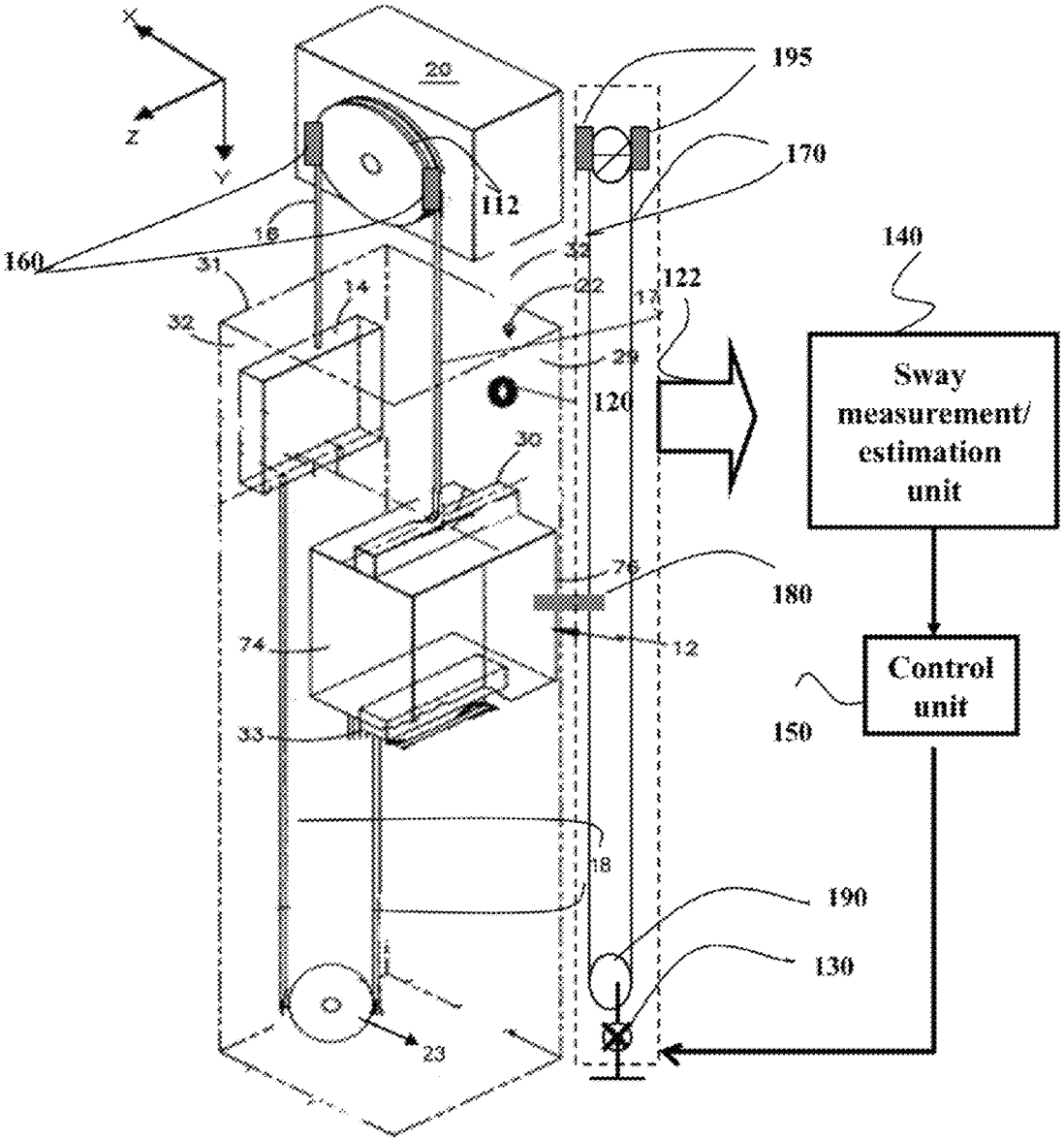

FIG. 1C shows a schematic of an elevator system 100-C according to yet another embodiment of an invention. In the system 100-C, the compensation sheave is constrained using brakes 180, and the main sheave 112 is controlled to rotate and create external tension in the main ropes, this tension stiffens the ropes and as a byproduct reduces the rope sway. The main sheave 112 is controlled by the control unit 150 that calculates the amplitude of the extra tension applied to the ropes. The control unit calculates also the time when the extra tension has to be switched on and when it has to be switched off. The timing of the switching is computed by the control unit 150 based on the rope sway measurements obtained from the sway FIG. 1D shows a schematic of an elevator system 100-D according to yet another embodiment of an invention. In the system 100-D, the main sheave is constrained using brakes 160 and the upper governor sheave 190 is constrained using brakes 195. The governor sheave 190 is controlled by an actuator 130 to pull/push on the governor sheave 190 and create external tension in the governor ropes 170. This tension implies a force on elevator car 12 through the link 180, which in turns creates a tension on the main ropes. The governor sheave 130 is controlled by the control unit 150 that calculates the amplitude of the extra tension applied to the ropes. The control unit calculates also the time when the extra tension has to be switched ON and when this tension has to be switched OFF. The timing of the switching is determined by the control unit 150 based on the rope sway determined by the sway unit 140.

Figure 1E:
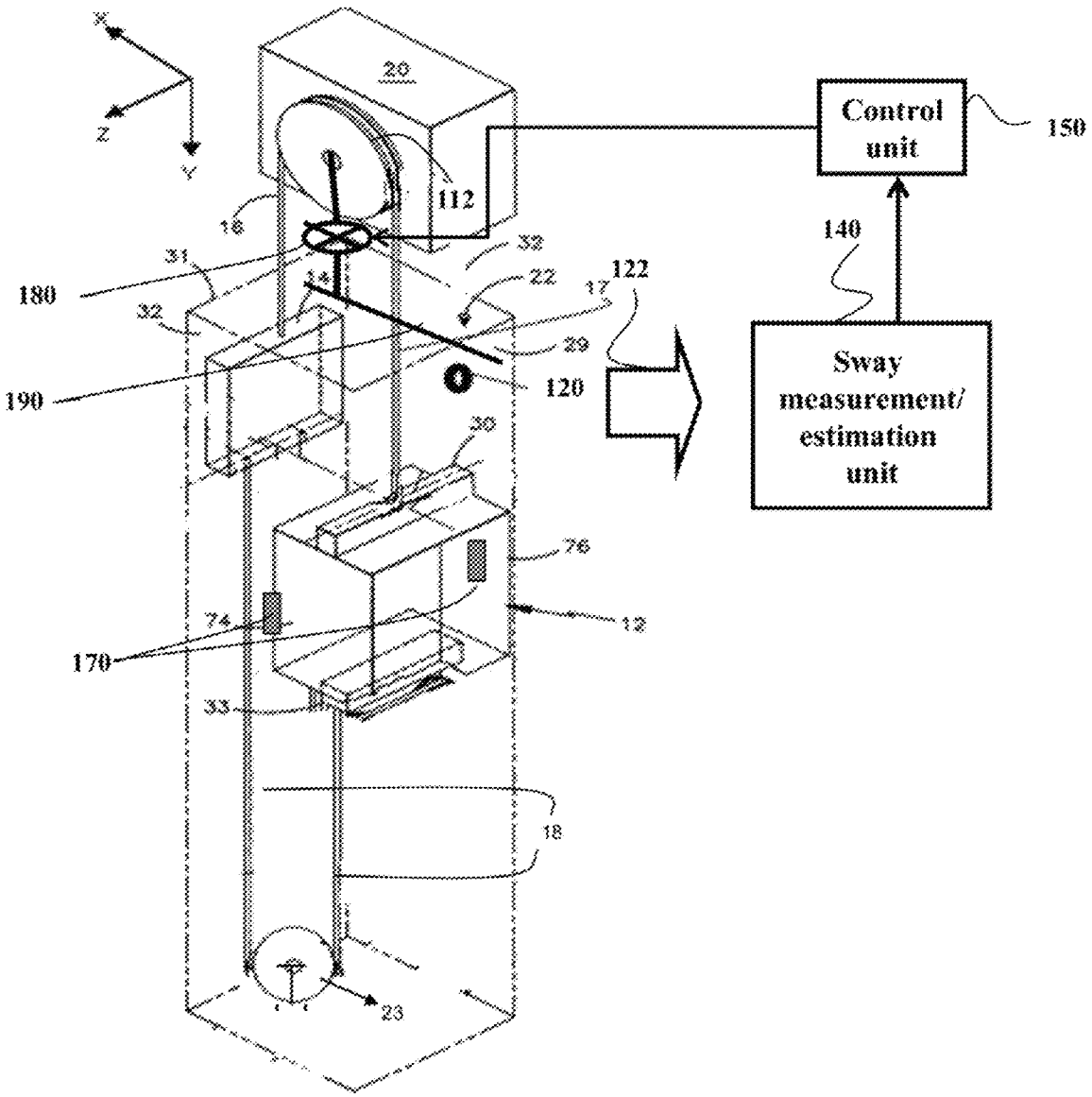

FIG. 1E shows a schematic of an elevator system 100-E according to another embodiment of an invention. In the system 100-E, the car motion is constrained using brakes 170, and the main sheave 112 is controlled using an actuator 180 mounted on a fixed stand 190. Operation of the breaks 170 generates external tension on the main ropes. This tension stiffens the ropes and reduces the rope sway. The actuator 180 is controlled by the control unit 150 that determines the amplitude of the extra tension applied to the ropes. The control unit also calculates the time when the tension is ON, and when the tension is OFF. The timing of the switching is determined by the control unit 150 based on the rope sway determined by the sway unit 140.

Other modifications of the elevator systems controlling the tension of the rope are possible and within the scope of the invention.

Model Based Control Design

Figure 2:
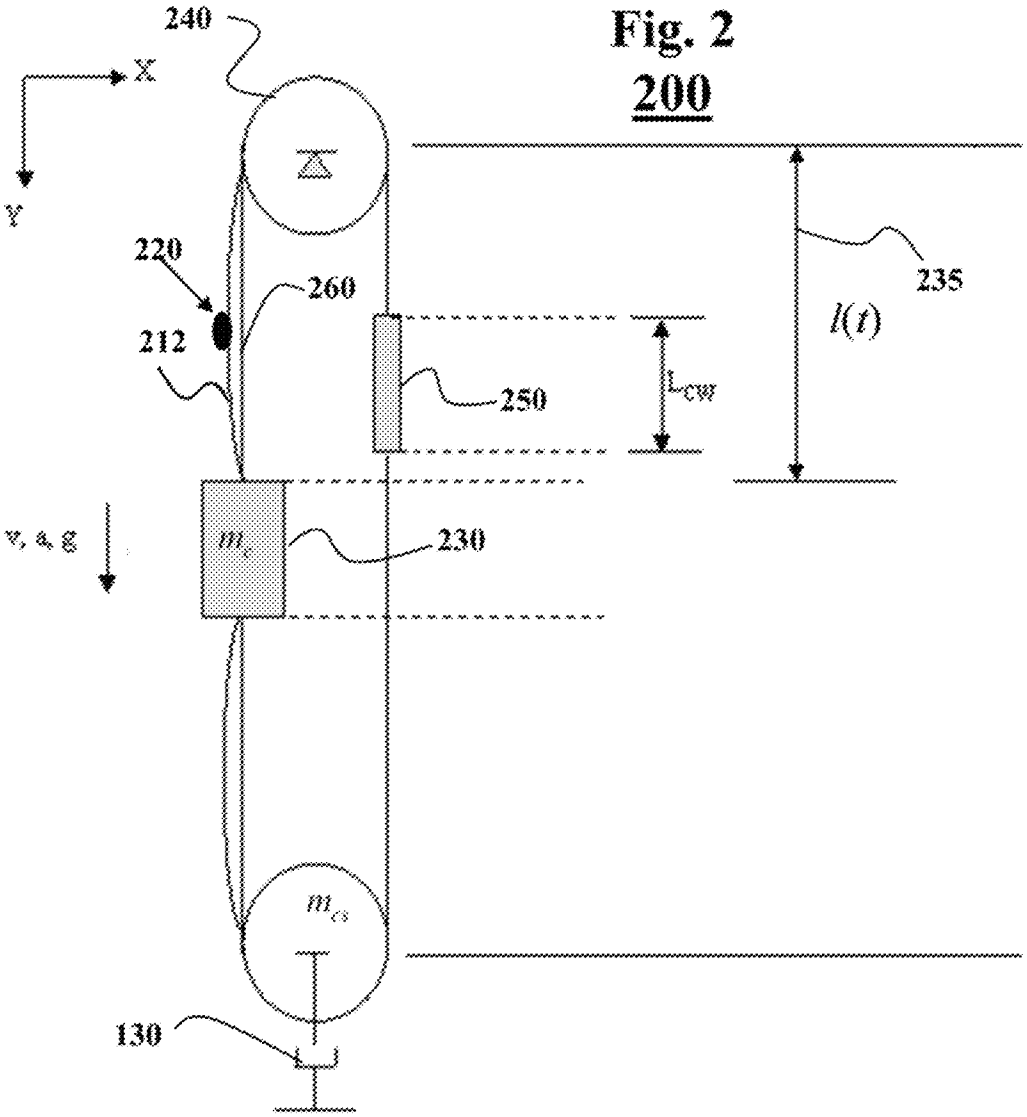
FIG. 2 is a schematic of a model of the elevator system according to an embodiment of the invention.

FIG. 2 shows an example of a model 200 of the elevator system. The model 200 is based on parameters of the elevator system 100-A. Various methods can be used to simulate operation of the elevator system according to the model of the elevator system, e.g., to simulate an actual sway 212 of the elevator rope caused by operating the elevator system. The models of other elevator systems can be similarly derived.

Various embodiments can employ different models of the elevator system to design the control law. For example, one embodiment performs the modeling based on Newton's second law. For example, the elevator rope is modeled as a string and the elevator car and the counterweight are modeled as rigid bodies 230 and 250, respectively.

In one embodiment, the model of the elevator system is determined by a partial differential equation according to $$\rho\left(\frac{\partial^2}{\partial t^2}+v^2(t)\frac{\partial^2}{\partial y^2}+2v(t)\frac{\partial}{\partial y\partial t}+a\frac{\partial}{\partial y}\right)u(y,t)-\frac{\partial}{\partial y}T(y)\frac{\partial u(y,t)}{\partial y}+c(y)\left(\frac{\partial}{\partial t}+v(t)\frac{\partial}{\partial y}\right)u(y,t)=0, \quad (1)$$

wherein $$\frac{\partial^i}{\partial V^1}(s(V))$$

is a derivative of order i of a function s(.) with respect to its variable V, t is a time, y is a vertical coordinate, e.g., in an inertial frame, u is a lateral displacement of the rope along the x axes, ρ is the mass of the rope per unit length, T is the tension in the elevator rope which changes depending on a type of the elevator rope, i.e. main rope, compensation rope, c is a damping coefficient of the elevator rope per unit length, v is the elevator/rope velocity, a is the elevator/rope acceleration.

Under the two boundary conditions $$u(0,t)=f_1(t),$$

and $$u(l(t),t)=f_2(t)$$

$f_1(t)$ is the first boundary condition representing the top building sway due to external disturbances, e.g. wind conditions, $f_2(t)$ is the second boundary condition representing the car sway due to external disturbances, e.g. wind conditions, l(t) is the length of the elevator rope 17 between the main sheave 112 and the elevator car 12.

For example, a tension of the elevator rope can be determined according to $$T=(m_e+\rho(l(t)-y))(g+a(t))+0.5M_{cs}g+U$$

wherein $m_e$, $m_{cs}$ are the mass of the elevator car and the pulley 240 respectively, g is the gravity acceleration, i.e., $g=9.8\ m/s^2$ and U is the extra tension force that is delivered by the actuator 130.

In one embodiment, the partial differential Equation (1) is discretized to obtain the model based on ordinary differential equation (ODE) according to $$M\ddot{q}+(C+G)\dot{q}+(K+H+\tilde{K})q=F(t) \quad (2)$$

wherein q=[q1, . . . , qN] is a Lagrangian coordinate vector, $\dot{q}$, $\ddot{q}$ are the first and second derivatives of the Lagrangian coordinate vector with respect to time. N is a number of vibration modes. The Lagrangian variable vector q defines the lateral displacement u(y, t) by $$u(y,t)=\sum_{j=1}^{j=N}q_j(t)\psi_j(y,t)+\frac{l-y}{l}f_1(t)+\frac{y}{l}f_2(t)$$

$$\psi_j(y,t)=\frac{\phi_j(\xi)}{\sqrt{l(t)}}$$

wherein $\phi_j(\xi)$ is a $j^{th}$ shape function of the dimensionless variable $\xi=y/l$.

In Equation (2), M is an inertial matrix, (C+G) constructed by combining a centrifugal matrix and a Coriolis matrix, (K+H+$\tilde{K}$) is a stiffness matrix and F(t) is a vector of external forces. The elements of these matrices and vector are given by:

$$M_{ij} = \rho\delta_{ij}$$

$$K_{ij} = \frac{1}{4}\rho l^{-2}\dot{l}^2\delta_{ij} - \rho l^{-2}\dot{l}^2\int_0^1 (1-\xi)^2\phi_i'(\xi)\phi_j'(\xi)\,d\xi + \rho l^{-1}(g+\ddot{l})\int_0^1 (1-\xi)\phi_i'(\xi)\phi_j'(\xi)\,d\xi + m_e l^{-2}(g+\ddot{l})\int_0^1 \phi_i'(\xi)\phi_j'(\xi)\,d\xi + \frac{1}{2}M_{cs}gl^{-2}\int_0^1 \phi_i'(\xi)\phi_j'\,d\xi$$

$$H_{ij} = \rho(l^{-2}\dot{l}^2 - l^{-1}\ddot{l})\left(\frac{1}{2}\delta_{ij} - \int_0^1 (1-\xi)\phi_i'(\xi)\phi_j'(\xi)\,d\xi\right) - c_p\dot{l}l^{-1}\left(\int_0^1 \phi_i(\xi)\phi_j'(\xi)d\xi + 0.5\delta_{ij}\right)$$

$$G_{ij} = \rho l^{-1}\ddot{l}\left(2\int_0^1 (1-\xi)\phi_i'(\xi)\phi_j'(\xi)\,d\xi - \delta_{ij}\right)$$

$$C_{ij} = c_p\delta_{ij}$$

$$F_i(t) = -l\sqrt{l}\,(\rho s_1(t) + c_p s_4(t))\int_0^1 \phi_i(\xi)\xi d\xi + \sqrt{l}\,(s_5(t) - \rho f_1^{(2)}(t))\int_0^1 \phi_i(\xi)\,d\xi$$

$$s_5(t) = -2v\rho s_2(t) - g(t)s_3(t) - c_p f_1^2(t)$$

$$s_1(t) = \frac{\dot{l}l - 2\dot{l}^2}{l^3}f_1(t) + \frac{\dot{l}}{l^2}\dot{f}_1(t) + \frac{\dot{l}}{l^2}\dot{f}_1(t) + \frac{1}{l^4}\left(l^3 f_2^{(2)}(t) - f_2(t)l^2 l^{(2)} + 2l\dot{l}^2 f_2(t) - 2l^2\dot{l}\,\dot{f}_2(t)\right) - \frac{\ddot{f}_1(t)}{l}$$

$$s_2(t) = \frac{\dot{l}}{l^2}f_l(t) - \frac{\dot{f}_1}{l} + \frac{\dot{f}_2}{l} - f_2\frac{\dot{l}}{l^2}$$

$$s_3(t) = \frac{f_2(t) - f_1(t)}{l}$$

$$s_4(t) = \frac{\dot{l}}{l^2}f_1(t) - \frac{\dot{f}_1}{l} + \frac{\dot{f}_2 l - f_2\dot{l}}{l^2}$$

$$\phi_i(\xi) = \sqrt{2}\sin(\pi i\xi),\ \delta_{ij}(\text{kronecker delta})$$

$$\tilde{K} = Ul^{-2}\int_0^1 \Phi_1'^2(\zeta)\,d\zeta = U\beta,$$

$$\beta = l^2\int_0^1 \Phi_1'^2(\zeta)\,d\zeta,$$

wherein $\dot{S}(.)$ is a first derivative of a function s with respect to its variable, the notation $S^{(2)}(.)$ is a second derivative of the function s with respect to its variable, and $$\int_{v0}^{vf} s(v)\,dv$$

is an integral of the function s with respect to its variable v over the interval $[v_0, v_f]$. The Kronecker delta is a function of two variables, which is one if the variables are equal and zero otherwise.

The system models given by Equation (1) and Equation (2) are two examples of models of the system. Other models based on a different theory, e.g., a beam theory, instead of a string theory, can be used by the embodiments of the invention.

Control Law

Some embodiments determine the control law to control the actuator 130. The actuator 130 changes the tension of the elevator rope based on the control law. One embodiment determines the control law for the case of one assumed mode, i.e., equation (2) with N=1, as described below. However, other embodiments similarly determine the control law for any number of modes. In various embodiments, the assumed mode is a mode of vibration of the elevator rope characterized by a modal frequency and a mode shape, and is numbered according to the number of half waves in the vibration of the elevator rope.

Figure 3:
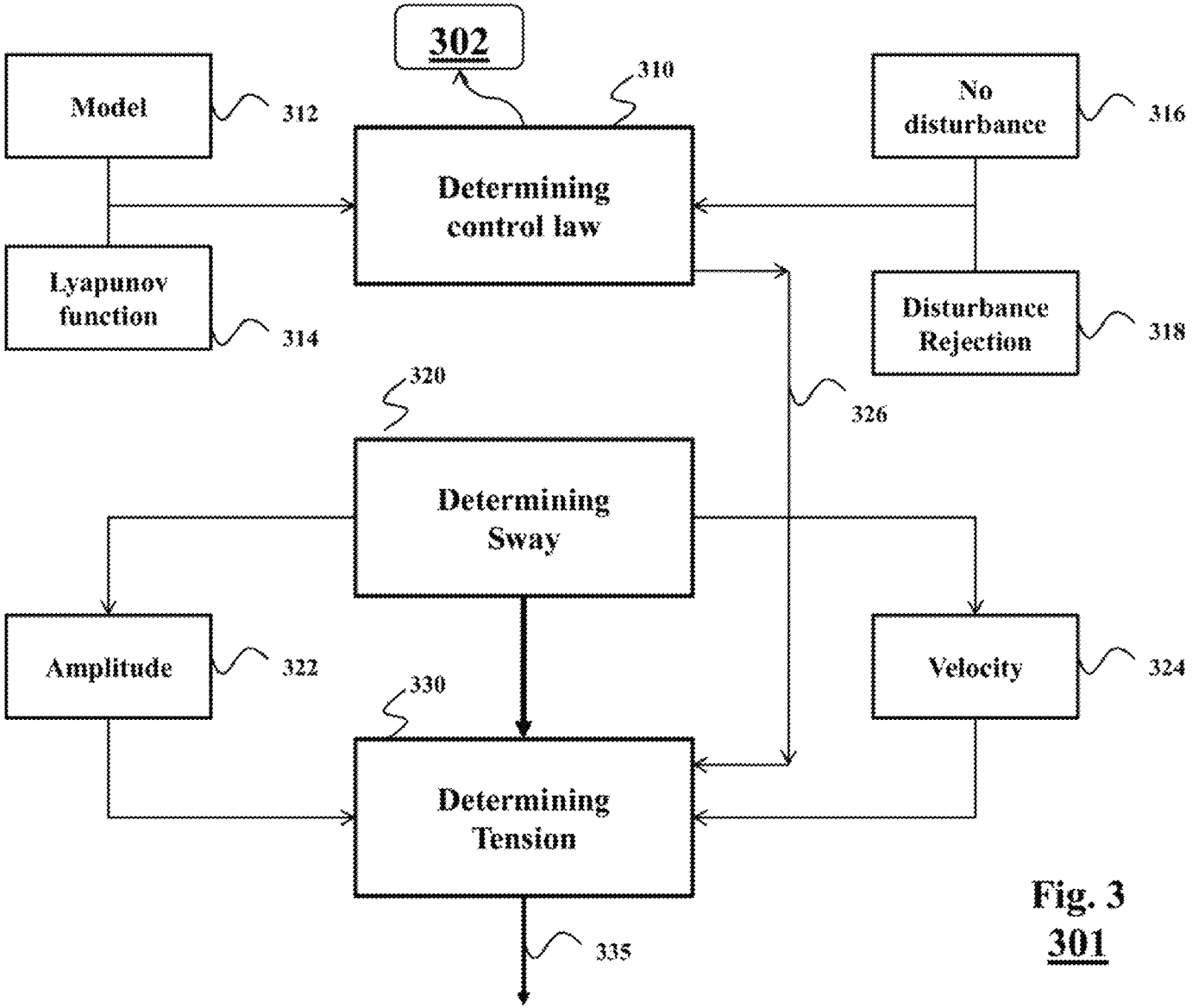
FIG. 3 is a block diagram of a method for controlling an operation of an elevator system according to an embodiment of the invention.

FIG. 3 shows a block diagram of a method for controlling an operation of an elevator system. The method can be implemented by a processor 301. The method determines 310 a control law 326 stabilizing a state of the elevator system using a tension 335 of an elevator rope supporting an elevator car in the elevator system. The control law is a function of an amplitude 322 of a sway of the elevator rope and a velocity 324 of the sway of the elevator rope, and determined such that a derivative of a Lyapunov function 314 along dynamics of the elevator system controlled by the control law is negative definite. The control law can be stored into a memory 302. The memory 302 can be of any type and can be operatively connected to the processor 301.

Such requirement ensures the stabilization of the elevator system and reduction of the sway. Also, determining the control based on Lyapunov theory allows applying the tension optimally, i.e., only when necessary to reduce the sway, and thus reduce the maintenance cost of the elevator system. For example, in one embodiment the control law is determined such that the tension of the elevator rope is proportional to the amplitude of the sway of the elevator rope.

In some embodiments, the control law is determined such that the tension is applied only in response to increasing of the amplitude of the sway of the rope. Thus when the sway is present, but is reducing during other factors of the operation of the elevator system, the tension is not applied. For example, the tension can be applied based on a sign of a product of the amplitude of a sway of the rope and the velocity of the sway of the rope.

One embodiment determines the control law 326 based on a model 312 of the elevator system with no disturbance 316. The disturbance include external disturbance such as a force of the wind or earth movement. This embodiment is advantageous when the external disturbance is minimal. However, such embodiment can be suboptimal when the elevator system is indeed subject to the disturbance.

Another embodiment modifies the control law with a disturbance rejection component 318 to force the derivative of the Lyapunov function to be negative definite. This embodiment is advantageous for the systems influenced by the disturbance. In one variation of this embodiment, the external disturbance is measured during the operation of the elevator system. In another variation, the disturbance rejection component is determined based on boundaries of the no external disturbance. This embodiment allows for compensating for disturbance without measuring the disturbance.

During the operation of the elevator system, the method determines 320 the amplitude 322 of the sway of the elevator rope and the velocity 324 of the sway of the elevator rope. For example, the amplitude and the velocity can be directly measured using various samples of the state of the elevator system. Additionally or alternatively, the amplitude and the velocity of the sway can be estimated using, e.g., a model of the elevator system and reduce number of samples, or various interpolation techniques. Next, the tension 335 of the elevator rope is determined based on the control law 326, and the amplitude 322 and the velocity 324 of the sway of the elevator rope. In some embodiments, the tension has a positive value and the tension 335 includes only a magnitude of the tension. In alternative embodiment, the tension 335 can also be negative and the tension 335 is a vector and includes the magnitude and the direction of the tension.

Lyapunov Control

Some embodiments use the tension of the rope and the Lyapunov theory to stabilize the elevator system, and thus stabilize the sway. By combining the Lyapunov theory and the rope tension actuation, a switching controller, according to some embodiments, optimizes switching the control tension ON and OFF based on switching conditions, e.g., amplitude and velocity of the actual sway. The switching condition as well as the amplitude of the positive tension to be applied is obtained based on the Lyapunov theory.

One embodiment defines a control Lyapunov function V(x) as $$V(x) = \frac{1}{2}\dot{q}^T(t)M\dot{q}(t) + \frac{1}{2}q^T(t)Kq(t),$$

wherein, q, $\dot{q}$ are the Lagrangian variables representing the assumed mode and its time derivative, M, K are the mass and the stiffness matrix respectively, defined in the model of Equation (2), and $x=[q, \dot{q}]^T$.

If the assumed mode equals one, the Lagrangian variables q, 4 are related to the sway u(y,t) and the sway velocity du(y,t)/dt by the equations $$u(y, t) = \frac{\sqrt{2}\sin\left(\frac{\pi y}{l}\right)q(t)}{\sqrt{l}};$$

$$du(y, t)/dt = \frac{\sqrt{2}\sin\left(\frac{\pi y}{l}\right)\dot{q}(t)}{\sqrt{l}}.$$

Figure 4A:
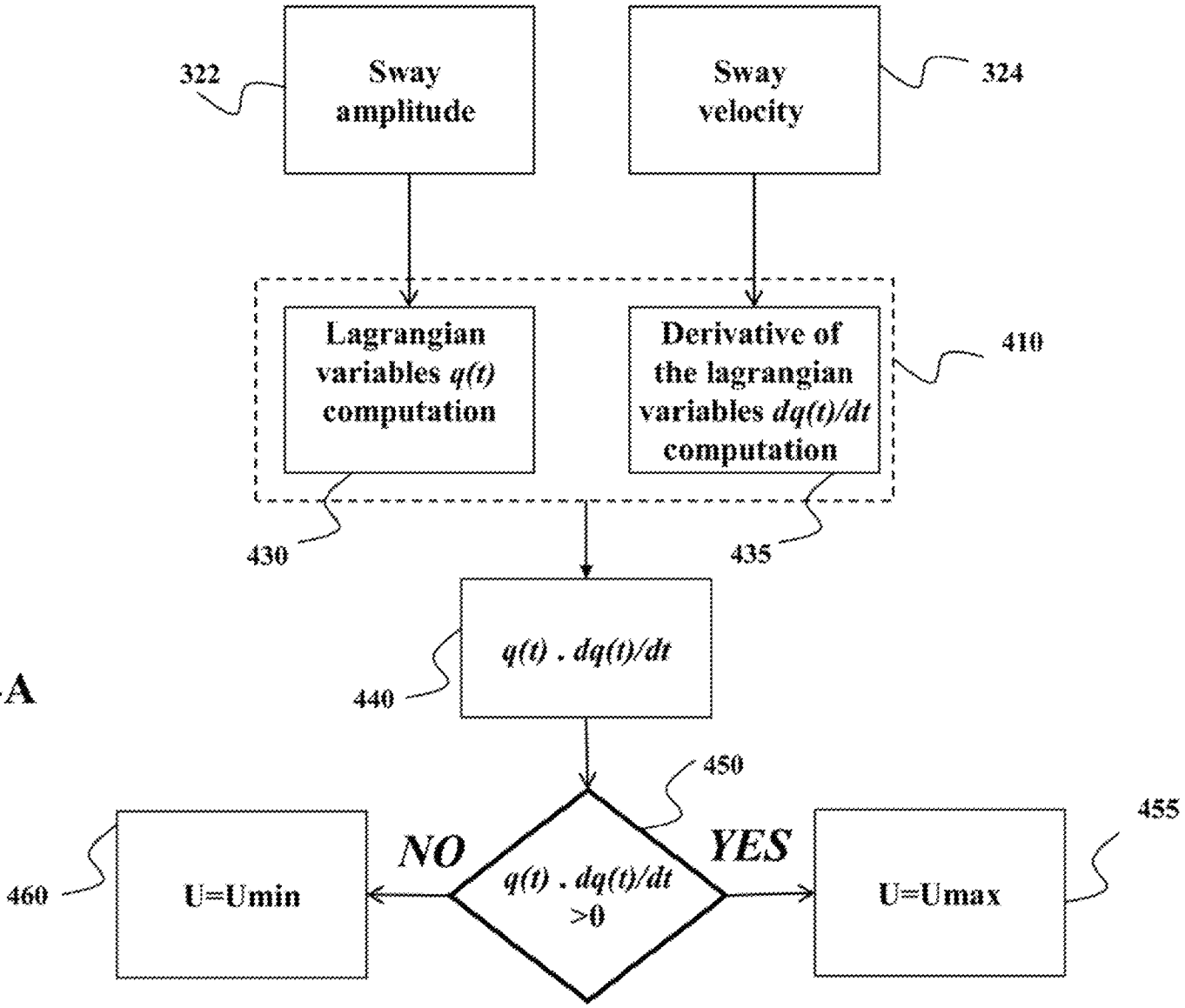
FIGS. 4A and 4B are block diagrams of methods for determining the control law based on Lyapunov theory according to various embodiments of the invention.

FIG. 4A shows a block diagram of a method for determining the control law based on Lyapunov theory. The Lagrangian variables q, $\dot{q}$ 430 and 435 are determined 410 based on the amplitude u(y,t) 322 and velocity du(y,t)/dt 324 sway. For example, one embodiment determines the Lagrangian variables according to $$q(t) = \frac{\sqrt{l}\,u(y, t)}{\sqrt{2}\sin\left(\frac{\pi y}{l}\right)}$$

$$\dot{q}(t) = \frac{\sqrt{l}\,du(y, t)/dt}{\sqrt{2}\sin\left(\frac{\pi y}{l}\right)}.$$

The sway amplitude u(y,t) and velocity du(y,t)/dt can be directly measured or estimated using various methods. For example, one embodiment determines the sway using sway sensors sensing the sway of the elevator rope at sway locations. Another embodiment determines the amplitude of the sway using samples of the sway and the model of the system. After the sway amplitude is determined, some embodiment determines the sway velocity using, e.g., a first order derivative $$du(y, t)/dt = \frac{u(y, t+\delta t) - u(y, t)}{\delta t},$$

wherein δt is the time between two sway amplitude measurements or estimations.

Some embodiments, determines the control law such that a derivative of the Lyapunov function along dynamics of the elevator system controlled by the control law U is negative definite. One embodiment determines the derivative of the Lyapunov function along the dynamics, e.g., represented by Equation (2), of the elevator system without disturbances, i.e. F(t)=0 for all t, according to $$\begin{aligned}\dot{V}(x) &= \dot{q}(-c\dot{q} - kq - \beta Uq) + kq\dot{q}\\ &= -c\dot{q}^2 - \beta Uq\dot{q},\end{aligned}$$

wherein coefficients c, k and β are determined according to the Equation (2).

To ensure the negative definiteness of the derivative $\dot{V}$, the control law according to one embodiment includes $$U(x) = \begin{cases} \text{u_max} & \text{if } \dot{q}q > 0 \\ u^* & \text{if } \dot{q}q \le 0 \end{cases} \tag{3}$$

In some embodiments u* is less or equals zero and more or equals −u_max.

This control law switches between two constants, e.g., u* and u_max, which is positive constant representing the maximum tension control. The tension applied to the elevator rope according this control law has a constant value, e.g., a maximum tension. A controller according to a control law (3) stabilizes the elevator system with no disturbance by switching between a maximal and a minimal control. This controller is easy to implement and is advantageous when the disturbance is unknown or minimal.

For example, in some embodiments the tension is applied based on a sign of a product of the amplitude of a sway of the rope and the velocity of the sway of the rope. The product is determined 440 and the sign is tested 450. If the sign is positive, then a maximum tension 455 is applied. If the sign is negative, then a minimum tension 460 is applied, e.g., no tension is applied, i.e., U=0.

Figure 4B:
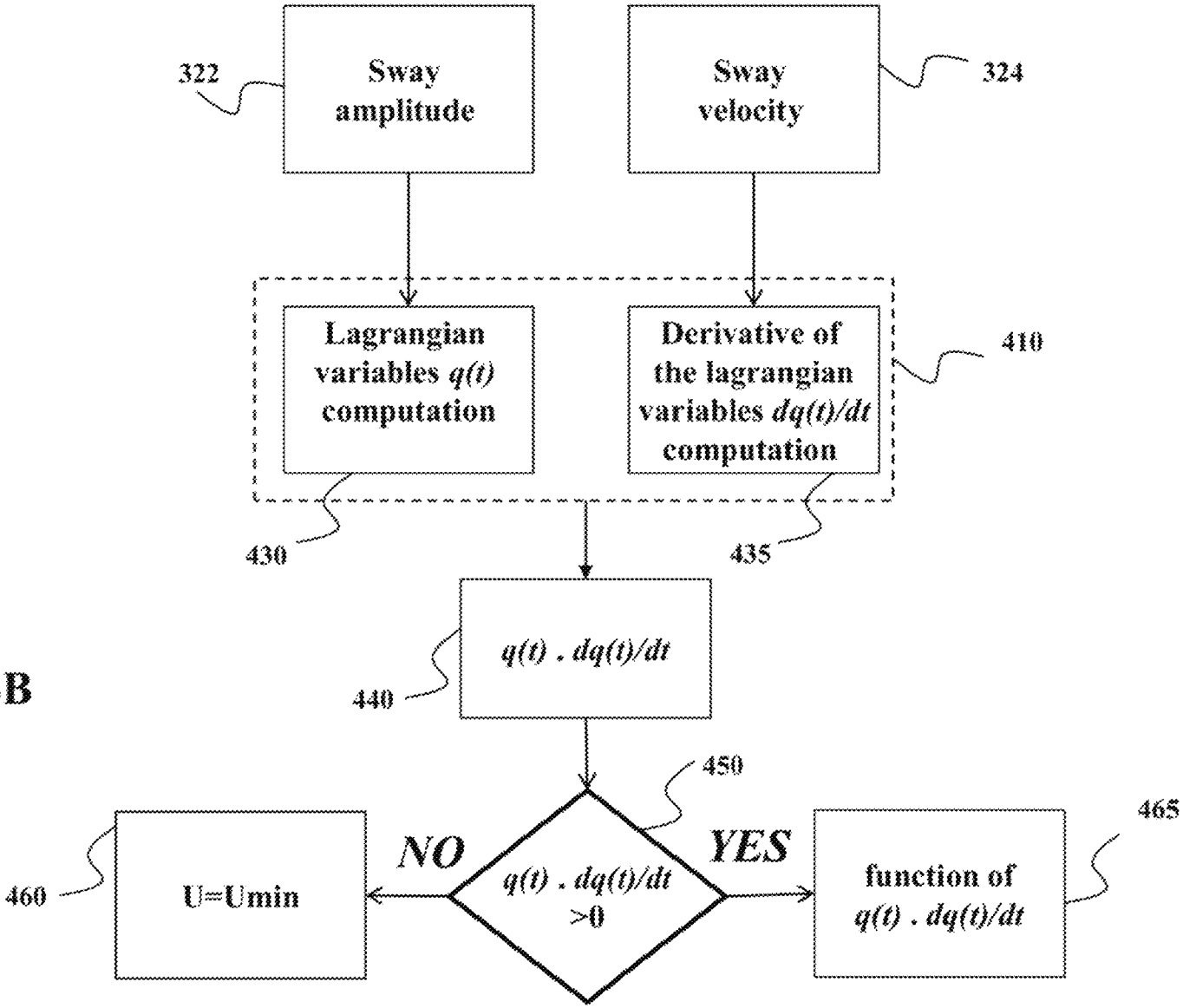

FIG. 4B shows a block diagram of an alternative embodiment that ensures the negative definiteness of the derivative $\dot{V}$. In this case, the tension applied to the elevator rope according to the control law of this embodiment is according to a varying function 465 of the amplitude and the velocity of the sway. In comparison with the previous embodiment, this embodiment can be advantageous because the embodiment uses less energy to control the sway.

According to this embodiment, the control law U(x) is $$U(x) = \begin{cases} \dfrac{kq\dot{q}}{\sqrt{1 + (q\dot{q})^2}} & \text{if } \dot{q}q > 0,\quad 0 < k \le \text{u_max} \\ 0 & \text{if } \dot{q}q \le 0, \end{cases} \tag{4}$$

wherein k is a positive feedback gain.

This choice of controllers leads to $$\dot{V}(x)\leq 0,$$

which by generalized LaSalle theorem for switched systems and the structure of the dynamics (2) with control laws according to Equations (3) or (4) implies that $(q, \dot{q})=(0,0)$ is globally exponentially stable when disturbance F(t)=0. The positive varying tension control 465 decreases with the decrease of the amplitude of the product $q\dot{q}$, which means when the sway amplitude gets smaller the tension applied to control also gets smaller. Thus, this varying control law uses less control energy.

Under the control according to the control law of Equation (4), the amplitude of the control decreases with the decreasing amplitudes of q, $\dot{q}$, and $|U|\leq u_max$. Thus, the control law is determined such that the tension of the elevator rope is proportional to the amplitude of the sway of the elevator rope, and uses high control tension when the sway or its velocity is high, because when the product q, $\dot{q}$ decreases the control tension decreases too.

Control Under Disturbance

The controllers (3), (4) stabilizes the elevator system when the disturbance F(t)=0, but when the disturbance F(t) is not zero, the Lyapunov function derivative is no longer forced to be zero all the time, because the derivative $\dot{V}$ is $$\begin{aligned}\dot{V}(x) &= \dot{q}(-c\dot{q} - kq - \beta Uq) + Kq\dot{q} + \dot{q}F(t)\\ &= -c\dot{q}^2 - \beta Uq\dot{q} + \dot{q}F(t)\end{aligned}$$

where the coefficient c, β are defined for Equation (2).

Due to the disturbance, the global exponential stability of the closed-loop dynamics of the elevator system can be lost. However, some embodiments are based on a realization that a state vector is bounded for bounded disturbance F(t), and thus the control law for the elevator system without the external disturbance 316 can be modified with a disturbance rejection component 318 to ensure that the derivative of the Lyapunov function is negative definite. Moreover, the disturbance rejection component can be determined based on boundaries of the external disturbance. This embodiment is advantageous when the direct measurement of the disturbance is not desirable.

Some embodiments determine the disturbance rejection component v(x) using Lyapunov reconstruction techniques. The control law without external disturbance $U_{nom}$ is modified with the disturbance rejection component according to $$U(x)=U_\{nom\}(x)+v(x)$$

In this case the Lyapunov derivative is $$\dot{V}(x)=\dot{q}(-c\dot{q}-kq-\beta Uq)+kq\dot{q}+\dot{q}F(t)-\beta vq\dot{q}\leq -\beta vq\dot{q}+\dot{q}F(t).$$

Some embodiments select v such that $\dot{V}(x)$ is negative definite. For example, one embodiment selects v satisfying an inequality $$+\dot{q}|F_max\leq\beta vq\dot{q},$$

where F_max represents an upper bound of the disturbance, and β is defined for Equation (2).

One embodiment selects v(x) as $$v(x)=\tilde{k}\text{sign}(\beta q\dot{q})(F_\{\max\}+\epsilon)|\dot{q}|,\tilde{k}>0,\ \epsilon>0,$$

where $\tilde{k}$, ϵ are two positive gains and F_max represents an upper bound of the disturbance force F(t) and the sign function is $$\text{sgn}(v):=\begin{cases}1 & \text{if } v>0\\ -1 & \text{if } v<0.\end{cases}$$

Accordingly, the derivative of the Lyapunov function is $$\dot{V}(x)=\dot{q}(-c\dot{q}-kq-\beta Uq)+kq\dot{q}+F(t)-\beta vq\dot{q}\leq|\dot{q}|F_\{max\}(1-\tilde{k}|\beta q\dot{q}|)-|\beta q\dot{q}||\dot{q}|\epsilon,$$

which ensures the convergence of the state vector to the invariant set $$S=\{(q,\dot{q})\epsilon R^2, s.t.(1-\tilde{k}|\beta q\dot{q}|)>0\}.$$

In this case, the norm of the state vector can be arbitrarily small by adjusting $\tilde{K}$. Because β<1, the large gains $\tilde{K}$ are needed to make the state vector converges to a small value.

However the controller $$u(x)=U_\{nom\}(x)+\tilde{k}\text{sign}(\beta q\dot{q})(F_\{\max\}+\epsilon)|\dot{q}|,\ \tilde{k}>0,\ \epsilon>0$$

is not practical for all applications, because a negative tension is not feasible using the actuation via the sheave rotation. The control law is then modified as $$u(x)=\max(U_\{nom\}(x)+\tilde{k}\text{sign}(\beta q\dot{q})(F_\{\max\}+\epsilon)|\dot{q}|,\ \tilde{k}>0,\ \epsilon>0 \quad (4).$$

The function max is $$\max(a, b)=\begin{cases}a & \text{if } a\geq b\\ b & \text{if } a<b\end{cases}$$

In control law of Equation (4), the sign function is discontinuous and can lead to fast switching on the controller, so called chattering effect. Some embodiments advantageously avoid chattering of the control signal by replacing the function max with a continuous approximation 'sat' function as follows $$u(x)=\max(U_\{nom\}(x)+\tilde{k}sat(\beta q\dot{q})(F_\{\max\}+\epsilon)|\dot{q}|,0),\ \tilde{k}>0,\ \epsilon>0.$$

The sat function is $$sat(v):=\begin{cases}\dfrac{v}{\tilde{\varepsilon}} & \text{if } |v|\leq\tilde{\varepsilon}\\ \text{sgn}(v) & \text{if } |v|>\tilde{\varepsilon}.\end{cases}$$

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. Though, a processor may be implemented using circuitry in any suitable format.

Further, it should be appreciated that a computer may be embodied in any of a number of forms, such as a rack-mounted computer, a desktop computer, a laptop computer, minicomputer, or a tablet computer. Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine. For example, some embodiments of the invention use MATLAB-SIMULIMK.

In this respect, the invention may be embodied as a computer readable storage medium or multiple computer readable media, e.g., a computer memory, compact discs (CD), optical discs, digital video disks (DVD), magnetic tapes, and flash memories. Alternatively or additionally, the invention may be embodied as a computer readable medium other than a computer-readable storage medium, such as a propagating signal.

The terms "program" or "software" are used herein in a generic sense to refer to any type of computer code or set of computer-executable instructions that can be employed to program a computer or other processor to implement various aspects of the present invention as discussed above.

Computer-executable instructions may be in many forms, such as program modules, executed by one or more computers or other devices. Generally, program modules include routines, programs, objects, components, and data structures that perform particular tasks or implement particular abstract data types. Typically the functionality of the program modules may be combined or distributed as desired in various embodiments.

Also, the embodiments of the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

I claim:

1. A method for controlling an operation of an elevator system, comprising:

determining a control law stabilizing a state of the elevator system using a tension of an elevator rope, such that a derivative of a Lyapunov function along dynamics of the elevator system controlled by the control law is negative definite, and wherein the control law is a function of an amplitude of a sway of the elevator rope and a velocity of the sway of the elevator rope;

determining the amplitude of the sway of the elevator rope and the velocity of the sway of the elevator rope during the operation; and determining a magnitude of the tension of the elevator rope based on the control law, and the amplitude and the velocity of the sway of the elevator rope, wherein the control law applies the tension based on a sign of a product of the amplitude of a sway of the rope and the velocity of the sway of the rope, wherein steps of the method are performed by a processor.

2. The method of claim 1, further comprising:

determining the control law for the elevator system based on a model of the elevator system without external disturbance; and modifying the control law with a disturbance rejection component to force the derivative of the Lyapunov function to be negative definite with the external disturbance.

3. The method of claim 1, wherein the control law is determined such that the tension of the elevator rope is proportional to the amplitude of the sway of the elevator rope.

4. The method of claim 1, wherein the control law applies the tension only in response to increasing of the amplitude of the sway of the rope.

5. The method of claim 1, wherein the control law U(x) includes $$U(x) = \begin{cases} \text{u_max} & \text{if } \dot{q}q > 0 \\ u^* & \text{if } \dot{q}q \le 0 \end{cases}$$

wherein u* is less or equals zero and more or equals −u_max, x=(q,q̇), and q, q̇ are Lagrangian variables representing an assumed mode and a time derivative of the assumed mode, u_max is a positive constant representing a maximum tension.

6. The method of claim 1, wherein the control law U(x) includes $$U(x) = \begin{cases} \dfrac{kq\dot{q}}{\sqrt{1+(q\dot{q})^2}} & \text{if } \dot{q}q > 0, \quad 0 < k \le \text{u_max} \\ 0 & \text{if } \dot{q}q \le 0, \end{cases}$$

wherein x=(q,q̇), and q, q̇ are the Lagrangian variables representing an assumed mode and a time derivative of the assumed mode, u_max is positive constant representing a maximum tension, and k is a positive feedback gain.

7. The method of claim 2, further comprising:

determining the disturbance rejection component v satisfying an inequality $$+\dot{q}|F\max \le \beta vq\dot{q},$$

wherein Fmax represents an upper bound of the disturbance F(t), q, q̇ are Lagrangian variables representing an assumed mode and a time derivative of the assumed mode, $$\beta = l^{-2}\int_0^1 \phi_1'^2(\xi)\,d\xi,$$

$\phi'_1(\xi)$ is a first derivative of a shape function $\phi_1(\xi)$ of the elevator rope having a length l.

8. The method of claim 1, wherein the control law u(x) includes $$u(x)=U_\{\mathrm{nom}\}(x)+\tilde{k}\,\mathrm{sign}(\beta q\dot{q})(F_\{\max\}+\epsilon)|\dot{q}|,\tilde{k}>0,\ \epsilon>0,$$

wherein x=(q,q̇), and q, q̇ are the Lagrangian variables representing an assumed mode and a time derivative of the assumed mode, and $\tilde{k}$, $\epsilon$ are two positive gains, $$\beta = l^{-2}\int_0^1 \phi_1'^2(\xi)\,d\xi,$$

$\phi'_1(\xi)$ is a first derivative of a shape function $\phi_1(\xi)$ of the elevator rope having a length l, F_{max} represents an upper bound of a disturbance F(t), U_{nom} represents a control law without the disturbance and a sign function is $$\mathrm{sgn}(v) := \begin{cases} 1 & \text{if } v > 0 \\ -1 & \text{if } v < 0. \end{cases}$$

9. The method of claim 1, wherein the control law u(x) of the amplitude x of the sway includes $$u(x)=\max(U_\{\mathrm{nom}\}(x)+\tilde{k}\,sat(\beta q\dot{q})(F_\{\max\}+\epsilon)|\dot{q}|,0),\ \tilde{k}>0,\ \epsilon>0,$$

wherein q, q̇ are the Lagrangian variables representing an assumed mode and a time derivative of the assumed mode, $\tilde{k}$, $\epsilon$ are two positive gains, $$\beta = l^{-2}\int_0^1 \phi_1'^2(\xi)\,d\xi,$$

$\phi'_1(\xi)$ is a first derivative of a shape function $\phi_1(\xi)$ of the elevator rope having a length l, F_{max} represents an upper bound of a disturbance F(t), U_{nom} represents a control law without the disturbance, and a sat function is $$sat(v) := \begin{cases} \frac{v}{\tilde{\varepsilon}} & \text{if } |v| \le \tilde{\varepsilon} \\ \mathrm{sgn}(v) & \text{if } |v| > \tilde{\varepsilon}. \end{cases}$$

10. A system for controlling an operation of an elevator system including an elevator car supported by an elevator rope, comprising:

an actuator controlling a tension of the elevator rope;

a sway unit determining an amplitude of a sway of the elevator rope and a velocity of the sway; and a control unit determining a sign of a product of the amplitude and the velocity of the sway and controlling the actuator according to a control law stabilizing a state of the elevator system, such that the control unit generates a command to apply the tension only in response to increasing the amplitude of the sway of the elevator rope indicated by the sign of the product.

11. The system of claim 10, wherein a magnitude of the tension is a constant.

12. The system of claim 10, wherein a magnitude of the tension is a function of the amplitude determined according to $$U(x) = \begin{cases} \frac{kq\dot{q}}{\sqrt{1+(q\dot{q})^2}} & \text{if } \dot{q}q > 0,\ \ 0 < k \le \mathrm{u_max} \\ 0 & \text{if } \dot{q}q \le 0, \end{cases}$$

wherein, q, q̇ are respectively Lagrangian variables representing an assumed mode and a time derivative of the assumed mode, u_max is positive constant representing a maximum tension, and k is a positive feedback gain.

13. The system of claim 10, further comprising:

a processor determining the control law such that a derivative of a Lyapunov function along dynamics of the elevator system controlled by the control law is negative definite; and a memory storing the control law, wherein the control unit determines a magnitude of the tension of the elevator rope based on the control law.

14. The system of claim 13, wherein the processor determines the control law for the elevator system without external disturbance; and modifies the control law with a disturbance rejection component to ensure that the derivative of the Lyapunov function is negative definite with the external disturbance.

15. The system of claim 14, wherein the processor determines the disturbance rejection component based on boundaries of the external disturbance.

16. The system of claim 14, wherein the disturbance rejection component based on a measurement of the external disturbance.

17. The system of claim 14, wherein the processor determines the disturbance rejection component v satisfying an inequality $$+\dot{q}|\mathrm{Fmax} \le \beta v q\dot{q},$$

wherein Fmax represents an upper bound of the disturbance F(t), q, q̇ are Lagrangian variables representing an assumed mode and a time derivative of the assumed mode, $$\beta = l^{-2}\int_0^1 \phi_1'^2(\xi)\,d\xi,$$

$\phi'_1(\xi)$ is a first derivative of a shape function $\phi_1(\xi)$ of the elevator rope having a length l.

18. A system for controlling an operation of an elevator system including an elevator car connected to an elevator rope, comprising:

a processor for generating a command to apply a tension to the elevator rope only in response to increasing of the amplitude of the sway of the elevator rope, wherein the processor generates the command according to a control law stabilizing a state of the elevator system using the tension of the elevator rope, such that a derivative of a Lyapunov function along dynamics of the elevator system controlled by the control law is negative definite, and wherein the control law applies the tension based on a sign of a product of the amplitude of a sway of the rope and the velocity of the sway of the rope.

* * * * *